United States Patent [19]

Cairns et al.

[11] 4,238,140

[45] Dec. 9, 1980

[54] TERMINAL BLOCK WITH ELECTRICAL CONNECTION MEANS WITH CONNECTOR LOCATION WALL AND LOCKING FINGER

[75] Inventors: Thomas M. Cairns, Birmingham; John H. Dewar, Grosse Ile; Emmons F. Sumner, Ann Arbor, all of Mich.

[73] Assignee: Ford Motor Company, Dearborn, Mich.

[21] Appl. No.: 16,469

[22] Filed: Mar. 1, 1979

[51] Int. Cl.[3] ..... H01R 13/64

[52] U.S. Cl. ..... 339/186 M; 339/147 R; 339/217 S; 339/262 F; 339/134

[58] Field of Search ..... 337/198; 339/147 R, 339/147 P, 184 R, 184 M, 126 R, 186 R, 186 M, 198 G, 198 GA, 198 K, 198 S, 154 R, 154 A, 217 S, 134, 262 F, 219 F, 113 R, 113 B, 66 R, 66 M, 258 R; 361/426, 430, 431, 357, 380, 347, 348

[56] References Cited

U.S. PATENT DOCUMENTS

| | | | |
|---|---|---|---|
| 2,831,087 | 4/1958 | Sundt | 200/133 |
| 2,851,671 | 9/1958 | Luce | 339/150 |
| 2,892,176 | 6/1959 | Gordon | 339/198 G |
| 2,955,178 | 10/1960 | Lanorr et al. | 200/133 |
| 3,060,293 | 10/1962 | Lapidus | 200/133 |
| 3,253,252 | 5/1966 | Piperato et al. | 339/198 |
| 3,731,257 | 5/1973 | Bakker | 339/66 M X |
| 3,775,273 | 11/1973 | Mamrick et al. | 337/245 |
| 3,775,274 | 11/1973 | Mamrick et al. | 337/245 |
| 3,848,951 | 11/1974 | Michaels et al. | 339/91 R |
| 3,851,224 | 11/1974 | Ege | 339/219 F X |
| 4,097,109 | 6/1978 | Cross | 339/258 F X |

*Primary Examiner*—Mark Rosenbaum

*Assistant Examiner*—Eugene F. Desmond

*Attorney, Agent, or Firm*—Peter Abolins; Clifford L. Sadler

[57] ABSTRACT

This specification discloses an automobile terminal block for receiving fuses and electrical connections to various electrical components of the automobile. Connection to the fuse blade contact from the rear of the terminal block is improved. The terminal block has a passage extending between the front and rear of the terminal block which has therein a fuse holder. The fuse holder is adapted to receive the blade contact of a fuse. The rear of the terminal block has openings for receiving accessory connectors to be connected to a portion of the fuse holder. The openings for the accessory connectors on the back of the terminal block have raised boundaries for distinguishing the openings and have a polarizing means so that each accessory connector is uniquely associated with one opening and can be inserted only in the correct orientation. The terminal block also includes a resilient finger having an extending protrusion which is received in an opening in the fuse holder thereby securing the fuse holder. A stop plate spaced from the resilient finger limits movement of the resilient finger out of the path of the fuse holder thereby limiting the stress which can be applied to the resilient finger so that the resilient finger does not break and remains in place to apply a locking force to the fuse holder. The terminal block has a configuration so that mounting brackets and additional auxiliary components can be attached to the basic terminal block to improve the versatility of the terminal block and extend its use to a greater variety of applications.

13 Claims, 18 Drawing Figures

FIG. 1.
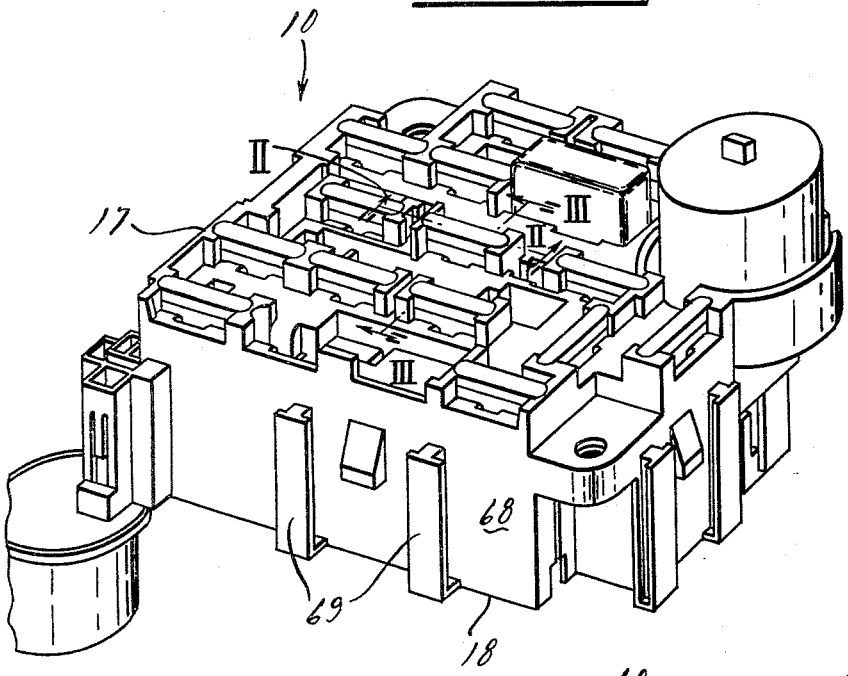
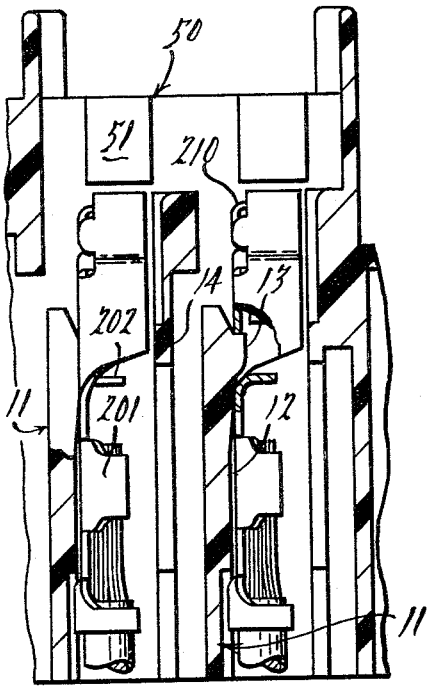
FIG. 2.
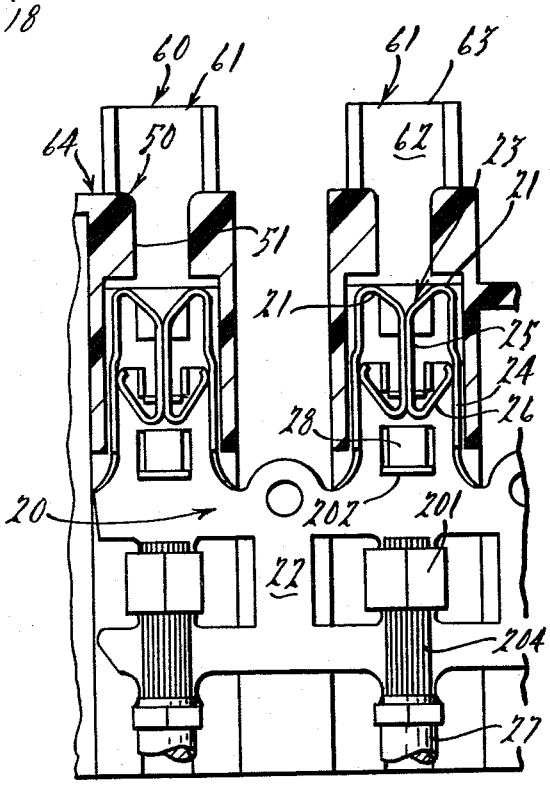
FIG. 3.

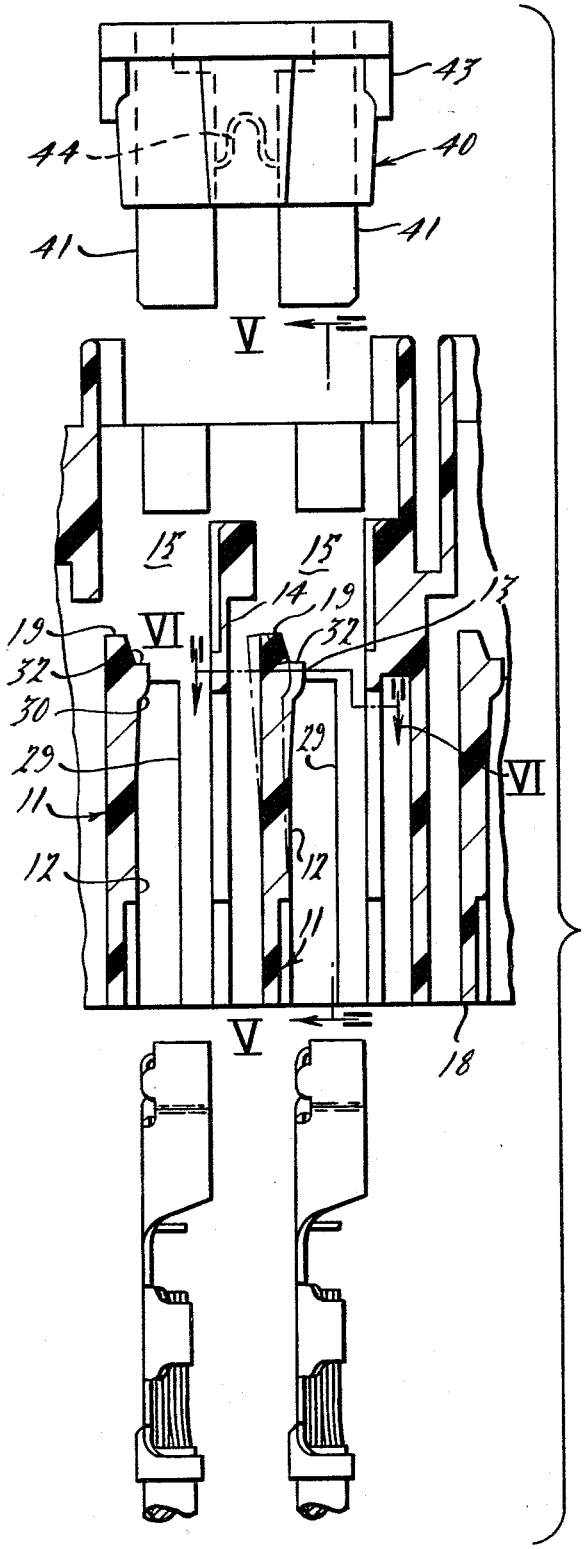
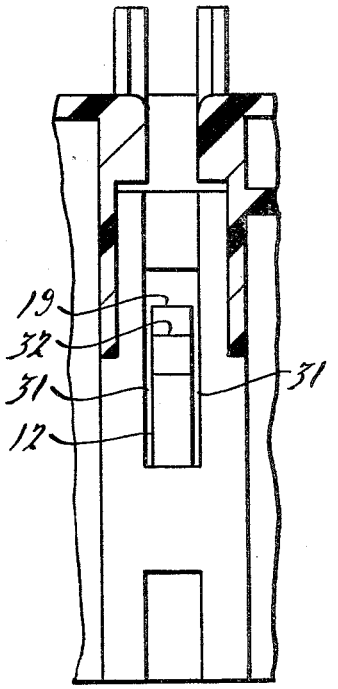
FIG. 5.
FIG. 4.
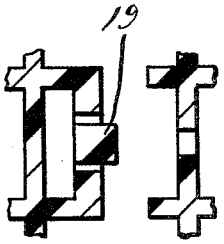
FIG. 6.

FIG. 7.
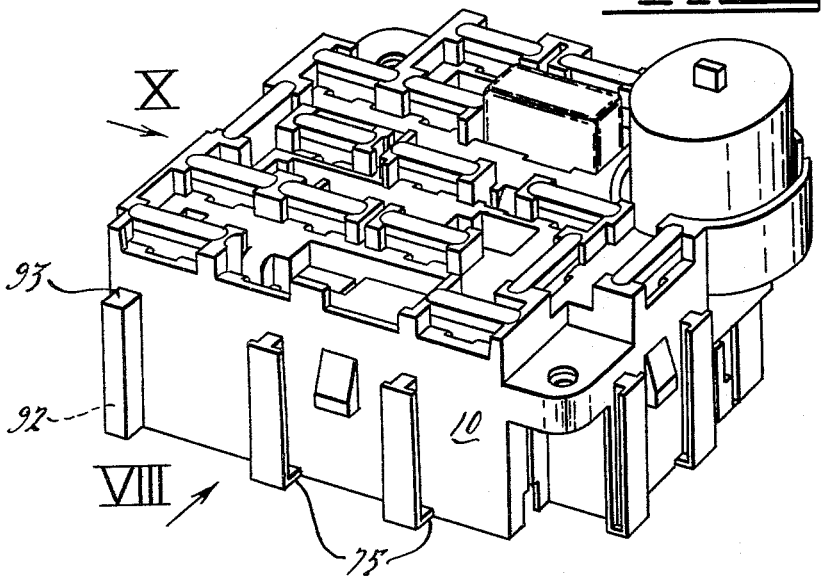
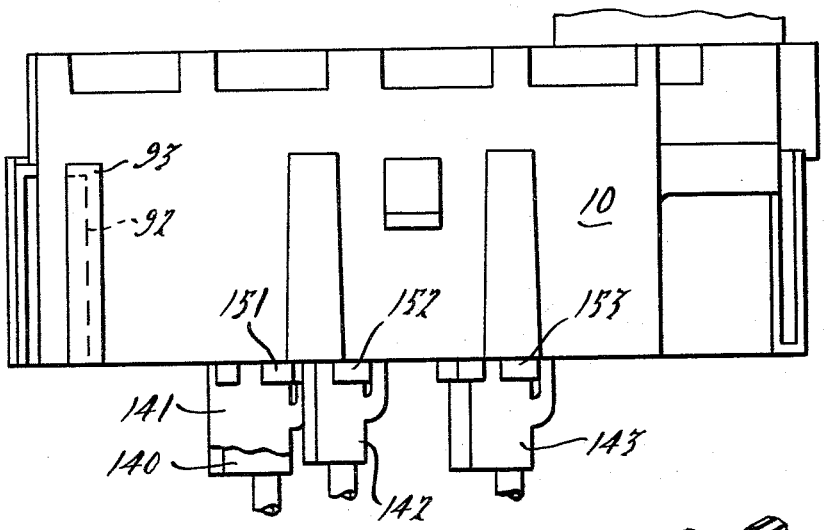
FIG. 8.
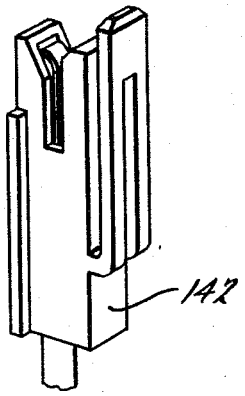
FIG. 9.

TERMINAL BLOCK WITH ELECTRICAL CONNECTION MEANS WITH CONNECTOR LOCATION WALL AND LOCKING FINGER

BACKGROUND OF THE INVENTION (1) Field of the Invention

This invention relates to electrical connections; and, more particularly, to a terminal block which removably secures various connections.

(2) Prior Art

Automobiles typically have a fuse terminal block which is mounted adjacent the instrument panel or forward fire wall to provide a means for securing fuses and for providing connections to various electrical components of an automobile such as headlights, horns, power seats, power windows and numerous electrical options which are available on automobiles and can be selected by the purchaser.

It is particularly desirable that connections for various automotive components be made to the fuse box in a manner which does not permit error or incorrect insertion. Further, although it is desired that the fuses and the means for holding the fuses and the electrical connectors to the various components of an automobile electrical system are securely positioned within the terminal block, it is also often desired that they be removable. Advantageously, the system should be completely "fool proof" to satisfy the needs of rapid and simple mass production of automobiles as well as facilitating repair of any faults in the terminal block requiring removal and reinsertion of the various electrical connections. Because of the desire of either the assembler or the repairer to use "short cuts" or to otherwise complete the job as quickly as possible without adequate assurance of quality of the completed apparatus, designing a simple and fool proof connection system has presented problems.

For example, in one known system taught in U.S. Pat. No. 4,097,109 issued to W. E. Cross, an accessory electrical connector which can be plugged into a cavity of a terminal block to a front opening. However, among the problems encountered with using such a connector is that there are many cavities in the front of the terminal block and it is difficult to find the correct one. For example, there are openings for fuses and various other components which are connected to the terminal block. Even if the correct cavity is chosen, there is still the problem of correctly orienting the electrical connector within the cavity.

With respect to fuses, FIG. 3 of U.S. Pat. No. 4,097,109 shows the fuse holder inserted into a passage in the terminal block and secured by barbs extending from the fuse holder. That is, the spring clips of the fuse holder have tines or outwardly extending barbs which engage the ridge in the terminal block and prevent withdrawal of the fuse holder. Thus, each spring clip of the fuse holder has a pair of tines which must be released from opposing ridges in order to remove the fuse holder. Not only are the tines or barbs susceptible to being bent and the fuse holder forced out without the barbs being retracted from the ridge, but the barbs may be retracted in such a way so as to overstress them and cause them to lose their resilience. Accordingly, if such a fuse holder is reinserted into the terminal block, the barbs will fail to secure the fuse holder and a poor structural connection may result. These are some of the problems this invention overcomes.

Additionally, although the economies of using a single terminal for all automotive applications for a given company are known, this has not been possible to realize. That is, a fuse terminal block which would be adequate for automobiles having an extensive electrical system, including many electrical options, would have excess capacity for a car having the minimum of electrical components. This excess capacity, of course, results in a cost penalty for the car with the reduced amount of electrical components. On the other hand, if the fuse terminal block is designed for the automobile with the smaller electrical system then there is not sufficient capacity in the fuse terminal block for a more extensive electrical system.

Similarly, a terminal block designed for mounting in one model may not be suitably configured for mounting in another model. Perhaps a different mounting position or packing configuration is required. These are also some of the problems this invention overcomes.

SUMMARY OF THE INVENTION

This invention recognizes an improvement in providing electrical connection and access to a fuse in an automotive fuse terminal block assembly. In particular, an opening within a terminal block for receiving an electrical accessory connector can have raised boundaries thereby facilitating locating the correct opening. Further, the accessory connectors can have a polarizing flange which mates with a polarizing slot in the opening thereby orienting the accessory connector with the opening. If desired, the shape of the cavities and the terminal connectors can be such that only the correct pair can be mated.

As a result, the chance of error is greatly reduced. The assembler and the repairer who must insert the accessory connectors is relieved of the burden of making sure that the proper connection is made. That is, only the proper connection can be made. Attempts to make an incorrect connection are thwarted by an impossible fit between the accessory connector and the connector opening in the terminal block.

This invention further recognizes that a resilient finger within a terminal block can have a protrusion which mates with an opening in a fuse holder thereby securing the fuse holder within the terminal block. There is a back stop means spaced from the resilient finger so that movement of the finger is sufficient to remove the protrusion from the opening in the fuse holder and yet limit movement so that the finger is not overstressed. Accordingly, even careless movement of the resilient finger can not cause overstressing of the finger. The possibility of broken resilient fingers is greatly reduced so that the coupling between the terminal block and the fuse holder is improved.

Advantageously, this invention further recognizes that an automobile fuse terminal block can include attachment means for expanding the electrical connection capability of the terminal block and altering the mounting connection of the terminal block. Accordingly, by providing this capability of altering both the electrical handling capability as well as changing the physical mounting capability, the terminal block can be used in a much greater variety of automotive applications and there can be greater economies in the fabrication cost of the basic component.

BRIEF DESCRIPTION OF THE DRAWINGS

FIG. 1 is a perspective view of a terminal block in accordance with an embodiment of this invention including mounted fuses;

FIG. 2 is a section view taken along line II—II of FIG. 1 including a fuse holder positioned within the terminal block;

FIG. 3 is a section view taken along line III—III of FIG. 1 including a fuse holder positioned within the terminal block;

FIG. 4 is an exploded view, partly in section, similar to FIG. 2 and further including a fuse;

FIG. 5 is a partially section view taken along line V—V of FIG. 4 including an elevation view of a resilient finger;

FIG. 6 is a section view taken along line VI—VI of FIG. 4;

FIG. 7 is a perspective view similar to FIG. 1 without an additional flasher mounted to the left corner;

FIG. 8 is a front elevation of the terminal block of FIG. 7 along a line of sight labeled VIII and includes accessory connectors inserted into connector openings having raised boundaries;

FIG. 9 is a perspective view of an accessory connector;

DETAILED DESCRIPTION OF THE INVENTION

Figure 10:
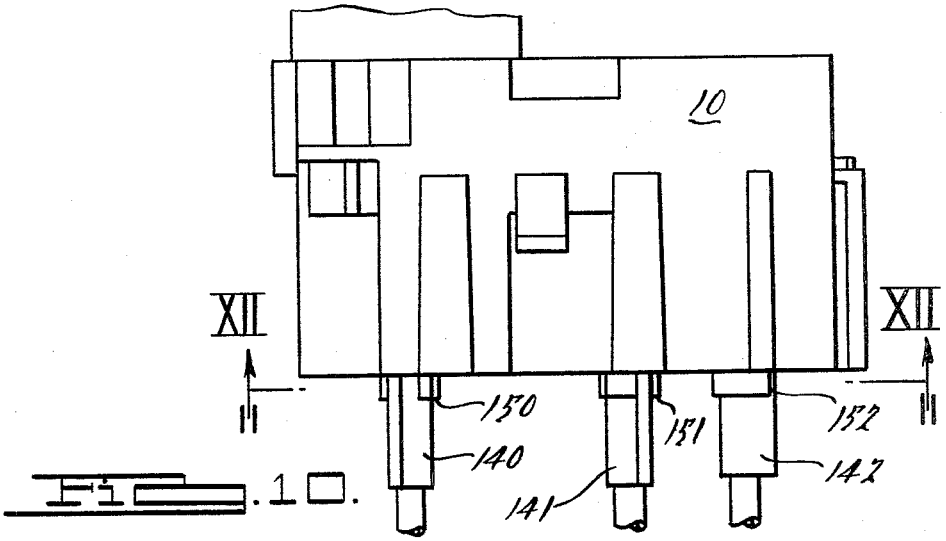
FIG. 10 is a side elevation of the terminal block of FIG. 7 along a line of signt labeled X and includes accessory connectors inserted into connector openings having raised boundaries.
Figure 11:
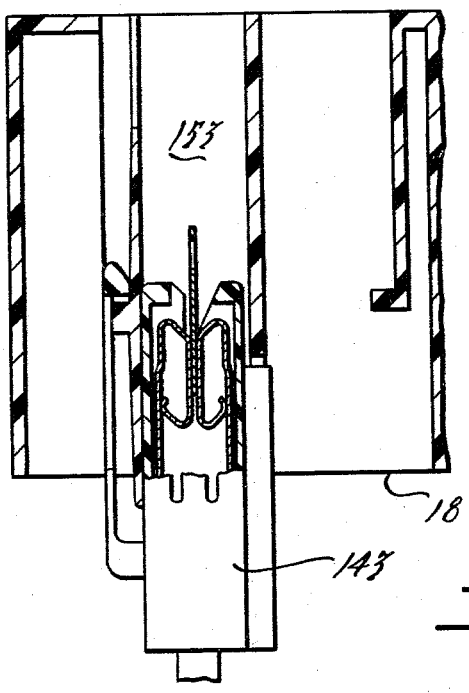
FIG. 11 is a section view showing an accessory connector inserted and locked in a connector opening.

Referring to FIG. 1, a terminal block 10 has the general shape of a rectangular solid with a plurality of passages 15 (FIG. 4) extending therethrough between a front (or top) surface 17 and a rear (or bottom) surface 18. At least some of passages 15 from top surface 17 of terminal block 10 are designed to receive a fuse 40 having a pair of spaced blade contacts 41. Fuse 40 is advantageously a miniature plug-in fuse similar to that described in U.S. Pat. No. 3,909,767 issued Sept. 30, 1975 and assigned to Littlefuse, Inc. At least some of passages 15 are accessible from bottom surface 18 of terminal block 10 and are adapted to receive a fuse holder 20 as shown in FIGS. 2 and 3. Further, various accessory connections can be made from the bottom or top of terminal block 10 to a bus bar portion 22 of fuse holder 20 or, in some cases, directly to blade contacts 41 of fuse 40.

Additional description of the above described fuse terminal block assembly can be found in the following copending applications, filed on even date herewith, the disclosures of which are incorporated by reference herein: Title of II—Fuse Holder with Entry Control, Ser. No. 16,468; Title of IV—Terminal Block with Fuse Guards and Identification Surface; Ser. No. 16,473; Title of VI—Fuse Holder with Insertion Ramp, Ser. No. 16,579.

Fuse 40 is a relatively small, flat element which includes a flat sheet metal stamping 42 partially situated within a plastic housing 43 (FIG. 4). Stamping 42 includes a fuse element 44, and blade contacts 41 which are a pair of laterally spaced protruding contact elements which are to be received between prongs 21 of spring clip 23 which is part of fuse holder 20 (FIG. 3).

Fuse holder 20 has a longitudinally extending bus bar 22 (FIG. 3) having laterally extending spring clips 23, each having a pair of prongs 21. Fuse holder 20 typically has a plurality of spring clips 23 along its length and at least a pair of attaching prongs 201 for connecting to an electrical lead 27. Prongs 21 have an outside portion 24, an intermediate portion 25 and an end portion 26. Between outside portion 24 and intermediate portion 25 there is a fold or bend and there is another fold or bend between intermediate portion 25 and end portion 26. Accordingly, spring clip 23 comprises two prongs 21 which are folded back on themselves twice so that the end portions 26 of each prong 21 bear resiliently against the outside portions 24 and the intermediate portions 25 of the two prongs 21 bear against each other. In use, a blade contact 41 of fuse 40 is held resiliently between intermediate portions 25 of the two prongs 21. Fuse holder 20 also includes an opening 28 associated with each spring clip 23 which acts in cooperation with a portion of terminal block 10 to secure fuse holder 20 in terminal block 10.

Within passage 15 there extends an elongated resilient finger 11 having an elongated body 12 at the end of which there is a protrusion 13. Behind resilient finger 11, in a direction opposite from protrusion 13, is a stop plate 14 (FIGS. 2 and 4). Stop plate 14 is spaced from and generally parallel to resilient finger 11 so that a bending movement of resilient finger 11 in the direction of stop plate 14 is limited. However, stop plate 14 is sufficiently spaced from resilient finger so that protrusion 13 can be deflected to the side of passage 15 thereby providing a clear path for the insertion of fuse holder 20 into passage 15.

Resilient finger 11 has an end portion 19 (see FIGS. 5 and 6) extending beyond protrusion 13 for providing a segment of finger 11 which can be engaged for bending finger 11. For example, a small screwdriver can be inserted into the top opening of passage 15 and extend down to engage end portion 19 and move finger 11 toward stop plate 14. Elongated body 12 of finger 11 forms a portion of the wall of passage 15 and has a longitudinal slit on each side separating body 12 from the remainder of wall 12 of passage 15. Protrusion 13 is shaped with a curved ramp 30 facing bottom surface 18 (FIG. 4) so that fuse holder 20 can pass over the ramp and a locking ledge 32 (FIG. 4) which extends through opening 28 in fuse holder 20 and prevents withdrawal of fuse holder 20 from passage 15. The cross section of protrusion 13 parallel to elongated body 12 is approximately the same as the open area of opening 28 in fuse holder 20 so that there is a good secure fit holding fuse holder 20 in terminal block 10. In FIG. 4, a resilient finger 11 is shown in phantom line after it has been bent until contact is made with stop plate 14. When undeflected, resilient finger extends sufficiently into passage 15 so that end portion 19 is accessible from top surface 17 through passage 15.

Referring to FIG. 3, a pair of passages 15 are shown side by side. Similarly, fuse holder 20 includes a pair of side by side spring clips 23 with a laterally connecting bus bar 22. The adjacent walls of the two passages 15 have a slot 29 (FIG. 4) to pass bus bar 22. A typical cross section of passage 15 has a rectangular shape with two long sides and two short sides (FIG. 6). Resilient finger 11 is defined in one of the long sides by a pair of spaced, parallel slots 31 (FIG. 5).

Referring to FIGS. 2 and 4, a pair of passages 15 can also be positioned so that they can receive the two blade contacts 41 of a single fuse 40. The resilient finger of one passage deflects back toward the wall opposing the resilient finger of the other passage. In effect, the stop means for one resilient finger doubles as a portion of the wall for another passage. Thus, wall portion can extend along the passage either from the same surface from which the associated resilient finger extends or from the opposing surface.

Figure 12:
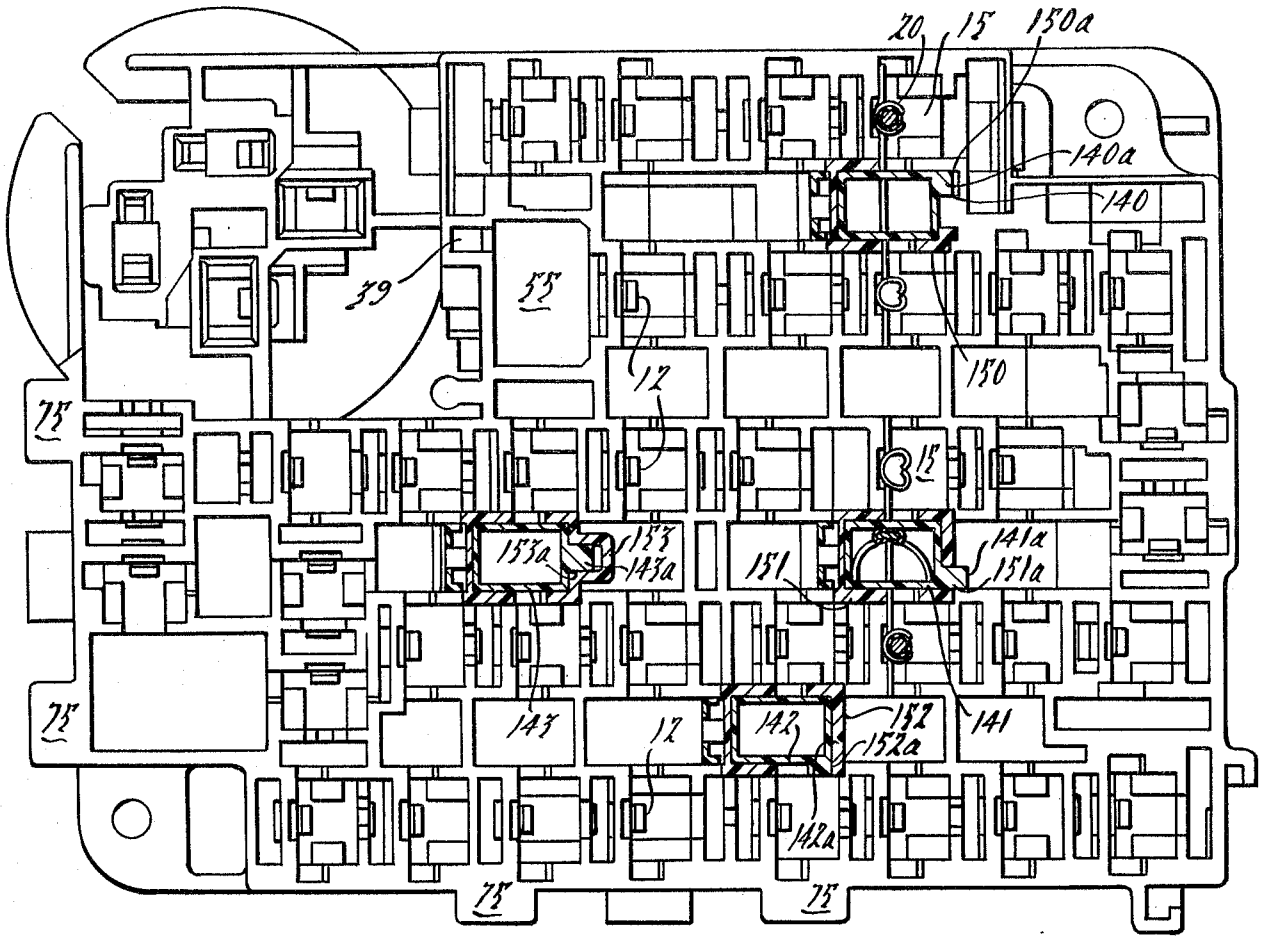
FIG. 12 is a section view taken along line XII—XII of FIG. 10 and shows the accessory connectors and raised walls of the connector openings in cross section and the remainder of the terminal block as a bottom plan view.

This invention is partly directed towards the configuration of openings which are positioned on the rear face of terminal block 10 (FIGS. 8, 10 and 12). An accessory connector 140 is adapted to be received within a cavity (wall) 150 in terminal block 10, an accessory connector 141 is adapted to be received within a cavity (wall) 151 in terminal block 10, an accessory connector 142 is adapted to be received within a cavity (wall) 152 in terminal block 10, an accessory connector 143 is adapted to be received in a cavity (wall) 153 in terminal block 10. Accessory connectors 140 through 143 have the same cross section configuration as the cavities 150 through 153, respectively, and are uniquely associated with the cavities so that only one terminal connector 140 through 143 can fit in any of the cavities 150 through 153. Each accessory connector 140 through 143 has a longitudinal ridge denoted by ridge 140*a*, 141*a*, 142*a* and 143*a*, respectively. The ridges are positioned at various angles extending out from the terminal connector. Similarly, each cavity (wall) 150 through 153 has a slot 150*a*, 151*a*, 152*a* and 153*a*, respectively, for receiving the ridge associated with the accessory connector. The slots and ridges are polarizing means which insure the correct orientation of the accessory connector within the cavity and the correct association of each accessory connector with the cavity. The cavities all have raised walls extending out from rear surface 18 to distinguish them from other openings in rear surface 18.

Cavities 140, 141 and 142 extend completely through terminal block 10 from front surface 17 to rear surface 18. Accordingly, accessory connectors 140, 141 and 142 can be inserted into terminal block 10 from front surface 17 as well as rear surface 18. This is because for example, bus bar 22 of fuse holder 22 is in cavity 150 and provides the same electrical connection point whether approached from the front or the bottom.

A connector adapter (not shown) inserts from the rear of terminal block 10 into an access 55 (FIG. 12) which extends from the rear of terminal block 10 to blade contact 41 of fuse 40. As a result, fuse holder 20 is not necessary and there can be a direct connection from the rear to blade contact 41 of fuse 40. The connector adapter has a spring clip similar to spring clip 23 and a housing for the spring clip to securely position the spring clip within terminal block 10. The housing includes an opening which receives a protrusion extending from terminal block 10 to lock the housing within terminal block 10. The protrusion extending from terminal block 10 is movable so that it can be removed from the opening and the housing removed from terminal block 10. The connector adapter has a polarizing ridge which acts in cooperation with a polarizing recess 39 (FIG. 12) in terminal block 10 which acts to orient the connector adapter with respect to terminal block 10 and thus the blade connector 41 of fuse 40.

Figure 13:
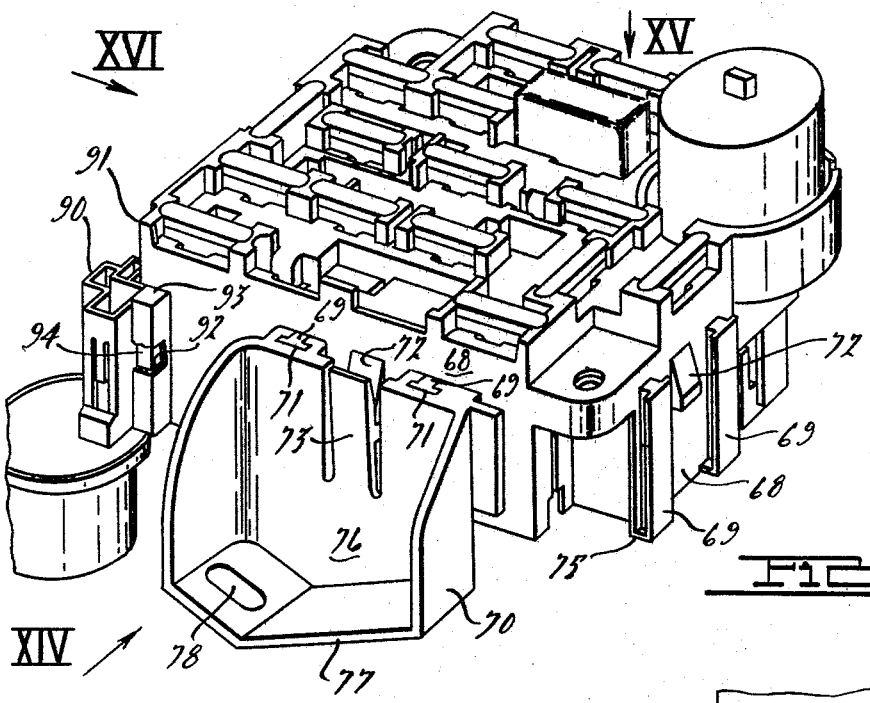
FIG. 13 is a perspective view of a terminal block including auxiliary components and mounting brackets in accordance with an embodiment of this invention.
Figure 14:
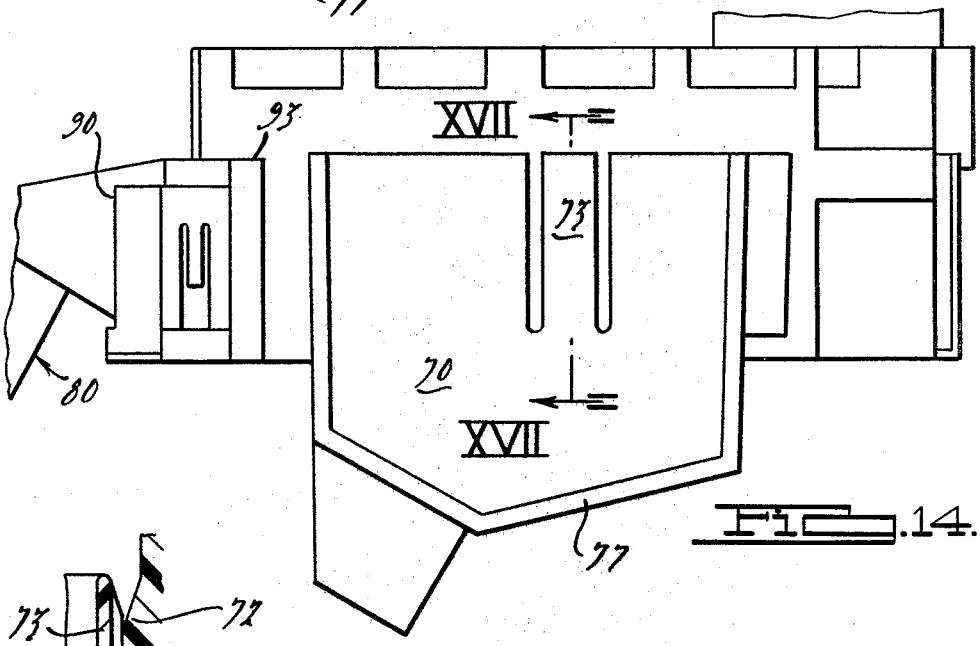
FIG. 14 is a front elevation view of the terminal block of FIG. 13 along a line of sight labeled XIV.
Figure 17:
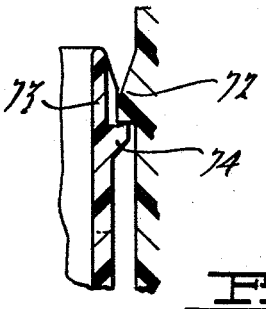
FIG. 17 is a section view taken along line XVII—XVII of FIG. 14.

Referring to FIG. 13, a side face 68 of terminal block 10 has a pair of spaced rails 69 for guiding an add-on mounting bracket 70. Mounting bracket 70 has two parallel recesses 71 (FIG. 15) with a T-shaped cross section adapted to receive therein rail 69. Between rail 69 on side face 68 is a locking protrusion 72 (FIG. 13). Mounting bracket 70 has a flexible tab 73 (FIG. 13) with a protrusion 74 extending therefrom (FIG. 17). One end of rail 69 has a blocking closure 75 (FIGS. 7 and 12) to limit the travel of mounting bracket 70 along rails 69. Mounting bracket 70 includes a generally planar surface 76 for supporting material defining recesses 71 and flexible tab 73 (FIG. 13). A flange 77 extends around the edge of planar surface 76 and includes an opening 78 for passing a mounting screw. It can readily be appreciated that the angle of the opening 78 in flange 77 can be varied to accommodate various mounting positions of terminal block 10 in various car models.

A variation of mounting bracket 70 is a mounting bracket 80 (FIGS. 15 and 16) which includes a planar surface 81 for supporting a pair of parallel recesses 82 and a flexible tab 83. A pair of side surfaces 84 and 85 extend from the edges of a planar surface 81 and are connected to planar surface 81 by ribs 86. One mounting flange 87 with an opening 88 (FIG. 16) is attached to side surface 84 for mounting bracket 80 and terminal block 10.

Figure 15:
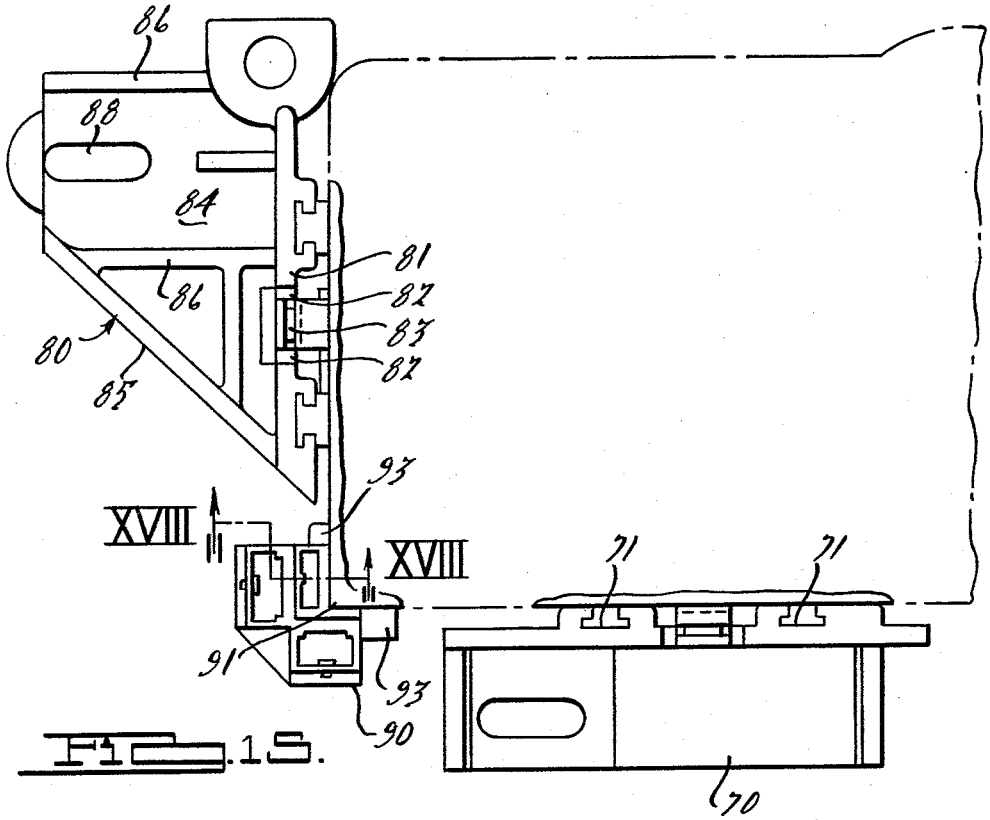
FIG. 15 is a top plan view of the terminal block of FIG. 13 along a line of sight labeled XV.
Figure 16:
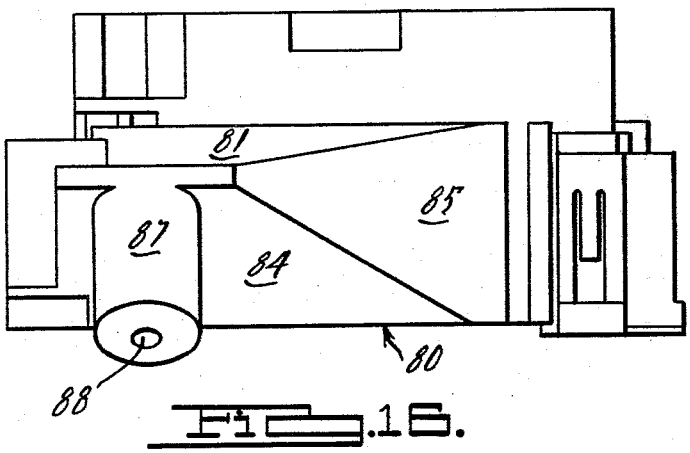
FIG. 16 is a side elevation view of the terminal block of FIG. 13 along a line of sight labeled XVI.
Figure 18:
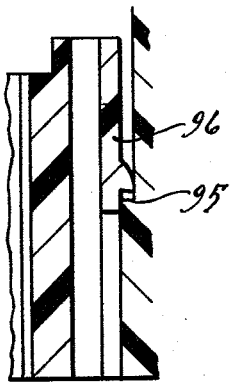
FIG. 18 is a section view taken along section line XVIII—XVIII of FIG. 15.

Terminal block 10 also has provisions for the additional mounting of a flasher attachment 90 on terminal block 10 (FIGS. 13, 15 and 18). An exterior corner 91 of terminal block 10 has on either side a pair of parallel slots 92 (FIG. 7) opening toward exterior corner 91. Slots 92 have a blocking enclosure 93 similar to that provided for rails 69. Indeed, slots 92 are basically defined by a ridge having a generally L-shaped cross section while rails 69 have a generally T-shaped cross section. Flasher attachment 90 includes a pair of opposing rib protrusions 94 which are angled with respect to one another to be received within slots 92. Between slots 92 on one of the side faces of terminal block 10 is located a step 95 (FIG. 18) for acting in cooperation with a flexible tab 96 of flasher attachment 90 so that flasher attachment 90 can be securely attached to terminal block 10.

Terminal block 10 is molded of a plastic material. A typical height of the walls surrounding the passages receiving the accessory connectors is 0.10. A typical length of passage 15 is 1.60 and accessory connector typically extends 0.80 into passage 15. A typical length of resilient finger 11 is 0.34 and a typical spacing between resilient finger 11 and stop plate 14 is about 0.10.

Various modifications and alterations will no doubt occur to those skilled in the various art to which this invention pertains. For example, the size and particular configuration of the accessory connectors may be varied from that disclosed herein; the shape of the protrusion from the resilient finger may vary from that described; and the shape of the add-on components can be varied from that described herein. These and all other variations which basically rely on the teachings through which this disclosure has advanced the art are properly considered within the scope of this invention.

I claim:

1. A fuse terminal block assembly including a terminal block having a generally rectangular solid shape with a front side, a rear or back side, side faces extending generally between said front and back sides, a plurality of passages extending from said front side to said back side of said terminal block, and a fuse holder with spring clips secured within a passage adapted for receiving the blade contact of a fuse in said spring clips, said front side adapted for receiving fuses, said back side adapted for receiving accessory connectors for connection to a fuse holder, said fuse holder including a bus bar portion laterally extending from said spring clips in said terminal block for selectively connecting said fuses and accessory connectors;

an elongated resilient finger extending into said passage for engaging said fuse holder, said resilient finger being an integral part of said terminal block and being movable within said passage;

a stop means positioned adjacent said resilient finger and integral with said terminal block to limit movement of said resilient finger out of the path of said fuse holder into said passage thereby avoiding overstress of said resilient finger; and said fuse holder having an opening for engagement of said resilient finger thereby securing said fuse holder in said passage;

a plurality of raised boundary walls defining connector openings in the rear of said terminal block for receiving one of said accessory connectors for electrical connection to a fuse holder, said raised boundary walls distinguishing said connector openings from any other openings in said back side, said resilient fingers and raised boundary walls combining to provide a secure and ready access to a fuse blade contact from said back side of said terminal block, electrical connection to a fuse blade contact being formed by said fuse holder, secured by said resilient finger and said accessory connector.

2. A fuse terminal block assembly as recited in claim 1 wherein said accessory connectors have a polarizing rib and each of said connector openings having a polarizing slot so that each opening is uniquely associated with only one of said accessory connectors, and further comprising:

front openings with access to said fuse holder bus bar whereby any accessory connector provides electrical connection to the same bus bar portion by insertion into the same connector opening from the front or the back.

3. A terminal block assembly as recited in claim 1 wherein said resilient finger includes an elongated portion having a longitudinal axis generally parallel to the longitudinal axis of said passage through said terminal block, and said resilient finger includes a protrusion extending from said elongated portion generally perpendicular to the longitudinal axis of said finger so that said protrusion extends into said passage and, when said resilient finger is undeflected, is in the path of said fuse holder into said passageway; and said stop means being positioned on the opposing side of said resilient finger from said protrusion thereby permitting movement of said protrusion out of the path of said fuse holder in said passage.

4. A terminal block assembly as recited in claim 3 wherein said stop means and said resilient finger are integrally molded and said protrusion is spaced from the end of said resilient finger thereby providing a surface between said protrusion and the end of said resilient finger, for receiving a tool for deflecting said resilient finger.

5. A terminal block assembly as recited in claim 4, wherein said terminal block includes an access space opening toward said protrusion sufficiently wide to permit movement of a tool engaging said resilient finger toward said stop means.

6. A terminal block assembly as recited in claim 5 wherein said opening in said fuse holder has approximately the same area as the cross section of said protrusion of said resilient finger thereby forming a tight fit between said fuse holder and said resilient finger and firmly securing said fuse holder within said terminal block.

7. A terminal block assembly as recited in claim 3 wherein said stop means and said resilient finger are elongated and extend from a common support base at positions spaced from one another so that said resilient finger and said stop means are substantially parallel along their length.

8. A terminal block assembly as recited in claim 7 wherein said resilient finger and said stop means are elongated and extend from opposing support bases so that said stop means and said resilient finger longitudinally approach one another from opposing directions and there is sufficient overlap so that deflection of said resilient finger sufficiently in a direction toward said stop means causes interference between said resilient finger and said stop means.

9. A terminal block assembly including a terminal block having a generally rectangular solid shape with a front side, a rear or back side, sides faces extending generally between said front and back sides, a plurality of passages extending from said front side to said back side of said terminal block, and a fuse holder with spring clips secured within a passage adapted for receiving the blade contact of a fuse in said spring clips, said front side adapted for receiving fuses, said back side adapted for receiving accessory connectors for connection to a fuse holder, said fuse holder including a bus bar portion laterally extending from said spring clips in said terminal block for selectively connecting said fuses and accessory connectors;

an elongated resilient finger extending into said passage for engaging said fuse holder, said resilient finger being an integral part of said terminal block and being movable within said passage;

a stop means positioned adjacent said resilient finger and integral with said terminal block to limit movement of said resilient finger out of the path of said fuse holder into said passage thereby avoiding overstress of said resilient finger; and said fuse holder having an opening for engagement of said resilient finger thereby securing said fuse holder in said passage;

said plurality of passages includes a first and a second passage adjacent to each other for receiving adjacent spring clips of said fuse holder, said first and second passages having first and second resilient fingers, respectively, and first and second stop means, respectively, said first and second passages being aligned along an axis generally perpendicular to the direction of movement of said resilient finger;

said first and second resilient fingers and said first and second stop means being on the same side of said first and second passages, respectively, with respect to said axis; and a first connector opening positioned between said first and second passages parallel to said axis so that a first fuse holder inserted into said first passage and a second fuse holder inserted into said second passage can have a lateral connecting member joining said first and second fuse holders, said connector opening being adapted to pass said lateral connecting member and provide for connection to said fuse holder by said accessory connector.

10. A terminal block assembly as recited in claim 9 wherein said first passage is an elongated space having a generally rectangular cross section with a pair of short sides and a pair of long sides having a pair of spaced longitudinal slits defining therebetween said first resilient finger;

said first stop means being positioned behind said resilient finger, in a direction parallel to said short sides, and spaced from said first resilient finger at least as much as said first resilient finger extends into the path of said fuse holder into said first passage; and said short sides having opposing, aligned slots adapted for receiving a portion of the fuse holder thereby permitting extension of said fuse holder from said first passage into said first connector opening.

11. A terminal block assembly as recited in claim 10 further comprising a third passage positioned adjacent said first passage, in a direction generally perpendicular to the direction from said first passage to said second passage, said third passage having a generally rectangular cross section with a pair of long sides and a pair of short sides, a first of said long sides having formed therein a resilient finger; and said first of said long sides being parallel to and spaced from one of said long sides of said first passage and the long side of said first passage forming a stop means for said resilient finger of said third passage.

12. A fuse terminal block assembly including a terminal block having a generally rectangular solid shape with a front side, a rear or back side, side faces extending generally between said front and back sides, a plurality of passages extending from said front side to said back side of said terminal block, and a fuse holder with spring clips secured within a passage adapted for receiving the blade contact of a fuse in said spring clips, said front side adapted for receiving fuses, said back side adapted for receiving accessory connectors for connection to a fuse holder, said fuse holder including a bus bar portion laterally extending from said spring clips in said terminal block for selectively connecting said fuses and accessory connectors;

an elongated resilient finger extending into said passage for engaging said fuse holder, said resilient finger being an integral part of said terminal block and being movable within said passage;

a stop means positioned adjacent said resilient finger and integral with said terminal block to limit movement of said resilient finger out of the path of said fuse holder into said passage thereby avoiding overstress of said resilient finger;

said fuse holder having an opening for engagement of said resilient finger thereby securing said fuse holder in said passage;

a pair of spaced parallel rails for guiding an add-on component to the terminal block and attaching the add-on component to said terminal block, a locking means positioned between said rails for securing said add-on component to said terminal block to prevent movement of the add-on component along said rails thereby locking the component to the terminal block;

said rails are positioned on different side faces of said terminal block and are adjacent an exterior corner, said add-on component includes a flasher attachment for securing to the exterior corner of a terminal block so that said terminal block can carry an additional flasher; and said locking means is a step between two planar areas and the adjacent side face of said terminal block at said exterior corner and the facing surface of said connector adapter are sufficiently spaced apart so as to permit the insertion of a tool, such as a screw driver, to release said add-on component from said locking means thereby facilitating removal of said connector adapter from said terminal block.

13. A fuse terminal block assembly as recited in claim 12 wherein said terminal block has two sets of spaced rails for coupling two mounting brackets to said terminal block, each of said sets of spaced rails being on a different side face of said rectangular solid;

each of said mounting brackets providing a connection point for mounting said terminal block to a portion of an automobile having a surface plane which is nonparallel to the plane of said front side of said terminal block thereby adapting said terminal block assembly for mounting on variously angled surfaces.

* * * * *